US006556687B1

(12) United States Patent
Manabe

(10) Patent No.: US 6,556,687 B1
(45) Date of Patent: Apr. 29, 2003

(54) SUPER-DIRECTIONAL LOUDSPEAKER USING ULTRASONIC WAVE

(75) Inventor: Koji Manabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/253,729

(22) Filed: Feb. 22, 1999

(30) Foreign Application Priority Data

Feb. 23, 1998 (JP) ..... 10-040020

(51) Int. Cl.[7] ..... H04R 25/00
(52) U.S. Cl. ..... 381/387
(58) Field of Search ..... 381/160, 26, 92, 381/387, 89; 181/139

(56) References Cited

U.S. PATENT DOCUMENTS

| | | | | | |
|---|---|---|---|---|---|
| 3,239,799 | A | * | 3/1966 | Boucheron | 367/119 |
| 3,723,962 | A | * | 3/1973 | Hotchner | 381/92 |
| 3,881,056 | A | * | 4/1975 | Gibson et al. | 381/160 |
| 4,037,052 | A | * | 7/1977 | Doi | 381/160 |
| 4,586,195 | A | * | 4/1986 | DeGeorge et al. | 381/92 |
| 4,703,462 | A | * | 10/1987 | Woodsum | 367/92 |
| 4,739,860 | A | * | 4/1988 | Kobayashi et al. | 181/123 |
| 4,796,726 | A | * | 1/1989 | Kobayashi et al. | 181/123 |
| 4,823,908 | A | * | 4/1989 | Tanaka et al. | 181/175 |
| 5,007,091 | A | * | 4/1991 | Alasaarela et al. | 381/26 |
| 5,233,664 | A | * | 8/1993 | Yanagawa et al. | 381/89 |
| 5,452,364 | A | * | 9/1995 | Bonham | 381/92 |
| 5,526,433 | A | * | 6/1996 | Zakarauskas et al. | 381/92 |
| 5,600,727 | A | * | 2/1997 | Sibbald et al. | 381/26 |
| 5,901,232 | A | * | 5/1999 | Gibbs | 381/92 |
| 6,011,855 | A | * | 1/2000 | Selfridge et al. | 310/324 |
| 6,186,004 | B1 | * | 2/2001 | Kaduchak et al. | 367/92 |

FOREIGN PATENT DOCUMENTS

| | | |
|---|---|---|
| JP | 60-106294 | 6/1985 |
| JP | 63-299499 | 12/1988 |
| JP | 6-178377 | 6/1994 |
| JP | 7-154893 | 6/1995 |

* cited by examiner

*Primary Examiner*—Rexford Barnie
*Assistant Examiner*—Phylesha Dabney
(74) *Attorney, Agent, or Firm*—Whitman, Curtis & Christofferson, P.C.

(57) ABSTRACT

A super-directional loudspeaker is provided, which makes for a listener to receive an audible sound at a high sound pressure with a compact size. This loudspeaker is comprised of a supporting member having a concave surface, and electro-acoustic transducer elements fixed to the supporting member. The elements are designed to receive an electrical input signal and to produce acoustic vibrations according to the electrical input signal thus received, thereby emitting directional ultrasonic waves in the air. The elements are arranged along the concave surface of the supporting member in such a way that the directional ultrasonic waves emitted by the elements propagate in the air to converge on a listening point in front of the concave surface. It is preferred that the curvature of the concave surface of the supporting member is adjustable according to the location of the listener.

17 Claims, 8 Drawing Sheets

SUPER-DIRECTIONAL LOUDSPEAKER USING ULTRASONIC WAVE

BACKGROUND OF THE INVENTION

1. Field of the Invention

The present invention relates to a loudspeaker using an ultrasonic wave and more particularly, to a super-directional loudspeaker having electro-acoustic transducer elements arranged on a curved surface to converge on a point, which makes it possible for a listener to listen anytime a sound emitted from the loudspeaker at a high sound pressure.

2. Description of the Prior Art

Conventionally, it has been known that a loudspeaker system with high directivity can be realized by using an ultrasonic wave.

For example, the Japanese Non-Examined Patent Publication No. 3-159400 published in July 1991 discloses a super-directional loudspeaker system comprising a super-directional loudspeaker using a parametric array, an ultrasonic wave receiver for receiving an ultrasonic wave beam which is emitted from the loudspeaker and reflected by a listener, and a controller for selecting sound sources on the basis of the reflected ultrasonic wave beam received by the receiver and for applying the selected sound source to the loudspeaker.

A first input signal, which is produced in a first one of the sound sources selected by the controller, is modulated and amplified to produce a first output signal. The first output signal is then applied to the super-directional loudspeaker, thereby emitting an ultrasonic wave beam. At this time, a first audible sound (e.g., a background music) according to the first input signal is emitted from the loudspeaker along with the ultrasonic wave beam thus emitted.

If a listener exists at a position in front of the loudspeaker, the listener can listen to the emitted first sound and at the same time, a part of the emitted ultrasonic wave beam is reflected by the listener and received by the ultrasonic wave receiver. If the level of the received ultrasonic wave beam is greater than a specific threshold value, a second one of the sound sources is selected by the controller instead of the first sound source. Then, a second input signal produced in the second sound source is modulated and amplified to produce a second output signal. The second output signal is applied to the super-directional loudspeaker, thereby emitting an ultrasonic wave beam containing a second audible sound (e.g., a shopping information) according to the second input signal. In this case, the listener listens to the emitted second sound.

If the level of the reflected ultrasonic wave beam is equal to or less than the specific threshold value or no reflected ultrasonic wave beam exists, the first sound is kept being emitted and the listener keeps listening to the first sound.

As described above, in the conventional super-directional loudspeaker system disclosed in the Japanese Non-Examined Patent Publication No. 3-159400, an ultrasonic wave beam is used as a carrier for an audio input signal of an audio frequency. Specifically, a high-frequency signal of an ultrasonic frequency is modulated by an input signal of an audio frequency. The modulated high-frequency signal is applied to electro-acoustic transducer elements of the loudspeaker, thereby emitting high-directional ultrasonic waves containing an audible sound according to the input signal. The ultrasonic waves thus emitted propagate in the air as a super-directional ultrasonic wave beam. The electro-acoustic transducer elements of the loudspeaker are arranged on a flat surface and as a result, the emitted ultrasonic waves propagate in parallel in the air.

Moreover, the Japanese Non-Examined Patent Publication No. 3-296399 published in December 1991 discloses a parametric loudspeaker system comprising a loudspeaker unit having ultrasonic oscillators arranged on a plate- or rod-shaped base, and a rotating means for rotating the loudspeaker unit around a specific rotation axis while the ultrasonic oscillators are located to face the rotation axis. The loudspeaker unit is rotatable so as to keep an angle with respect to the rotation axis acute, where the angle can be adjusted by the rotating means as necessary.

A high-frequency signal of an ultrasonic frequency is modulated by an input signal of an audio frequency and amplified. The modulated and amplified signal is then applied to the ultrasonic oscillators of the loudspeaker unit, thereby emitting high-directional ultrasonic waves containing an audible sound according to the input signal. Since the ultrasonic oscillators of the loudspeaker unit are arranged on the plate- or rod-shaped base, the emitted ultrasonic waves propagate in parallel in the air as a beam.

Further, the loudspeaker unit is rotated around the rotation axis to form a circular cone. Therefore, the ultrasonic waves emitted from the ultrasonic oscillators are converged on a point where a listener is located in front of the loudspeaker unit. If the acute angle between the loudspeaker unit and the rotation axis is changed in value by the rotating means, the focusing point of the ultrasonic waves can be changed so as to follow the change of the point of the listener.

As described above, in the conventional parametric loudspeaker system disclosed in the Japanese Non-Examined Patent Publication No. 3-296399, similar to that disclosed in the Japanese-Non Examined Patent Publication No. 3-159400, an ultrasonic wave beam is used as a carrier for an audio input signal of an audio frequency. Specifically, a high-frequency signal of an ultrasonic frequency is modulated by an input signal of an audio frequency. The modulated high-frequency signal is applied to electro-acoustic transducer elements arranged on a flat surface, thereby emitting ultrasonic waves containing an audible sound according to the input signal. However, unlike the case of the Japanese-Non Examined Patent Publication No. 3-159400, the ultrasonic waves emitted from the loudspeaker unit propagate to be focused on an optional point.

FIG. 1 is a block diagram showing the common basic configuration of the above-described two conventional loudspeaker systems.

As shown in FIG. 1, an audio signal source 110 generates an electric audible signal S101 of a variable audio frequency. A high-frequency oscillator 150 generates an electric high-frequency signal S102 of a fixed ultrasonic frequency. An amplitude modulator 120 amplitude-modulates the high-frequency signal S102 by the audio signal S101, thereby producing a modulated ultrasonic signal S103. A power amplifier 130 amplifies the modulated ultrasonic signal S103 to produce an amplified ultrasonic signal S104.

An electro-acoustic transducer unit (i.e., a loudspeaker unit) comprise a plurality of electro-acoustic transducer elements 145 arranged on a flat surface of a suitable supporting member (not shown). The transducer elements 145 convert the amplified ultrasonic signal S104 to acoustic vibrations of the same ultrasonic frequency as that of the high-frequency signal S102. The acoustic vibrations of the same ultrasonic frequency, which are produced by the transducer elements 145, generate high-directional ultrasonic waves USW and emit them into the air. The ultrasonic waves USW thus emitted propagate in the air as an ultrasonic wave beam with a super directivity.

While the ultrasonic waves USW propagate in the air, a nonlinear interaction occurs between the ultrasonic waves USW and the air, resulting in demodulation operation of the ultrasonic waves USW. As a consequence, an audible sound according to the audio signal S101 of the audio frequency is generated in the air and transferred by the beam of the ultrasonic waves USW. In other words, a super-directional audible sound wave is generated in the air. This phenomenon has been termed the "parametric array effect".

If a listener is located at any one of locations in the propagation direction of the beam of the ultrasonic waves USW, the listener can listen to the audible sound. However, if the listener is located out of the propagation direction, the listener is unable to listen to the audible sound because of its super directivity.

With the conventional loudspeaker system having the conventional common basic configuration shown in FIG. 1, however, the following problems will occur.

A first one of the problems is that the listener is unable to receive the audible sound at a satisfactorily high sound pressure. This problem is caused by the fact that the electro-acoustic transducer elements 145 are arranged on the flat surface and therefore, the energy of the acoustic vibrations formed by the elements 145 is likely to scatter or diffuse in the air. In other words, the listener tends to receive only a small part of the acoustic vibrations.

A second one of the problems is that the circuit configuration of the loudspeaker system is complicated and the fabrication cost thereof is high. This problem is caused by the fact that the number of the transducer elements 145 needs to be increased in order to raise the sound pressure of the audible sound emitted by the elements 145, thereby increasing the overall output of the transducers 145. At the same time, this problem is also caused by the fact that the gain of the power amplifier 130 needs to be higher.

On the other hand, a technique to converge an acoustic vibration emitted from an electro-acoustic transducer element on a point by the use of a paraboloidal reflector is disclosed in the Technical Report of the Institute of Electronics, Information and Communication Engineers (IEICE), pp. 25–30, EP94-37, August 1994, which is entitled "a Spatial Sound Source Made by Focused Parametric Array Sound Beam".

In this technique, an electro-acoustic transducer element is located in front of a paraboloidal concave surface of a paraboloidal reflector. When the transducer element emits an acoustic vibration of an ultrasonic frequency according to an applied input signal, an ultrasonic wave is emitted from the element toward the reflector at a specific solid angle. The ultrasonic wave thus emitted propagates in the air to the reflector and then, is reflected by the paraboloidal concave surface of the reflector. Thus, the reflected ultrasonic wave propagates in the air so as to converge on a point in front of the concave surface.

Therefore, the previously-described first and second problems may be solved by applying the above-described technique disclosed in the technical report of IEICE to one of the conventional loudspeaker system disclosed in the Japanese-Non Examined Patent Publication Nos. 3-159400 and 3-296399. In this case, however, a problem that the size of the loudspeaker unit of the loudspeaker system becomes large will occur. This problem is caused by the following two reasons.

Specifically, first, to converge the reflected ultrasonic wave on the converging point, the reflector having the paraboloidal concave surface is essentially located apart from the electro-acoustic transducer element by a specific distance. The technical report of IEICE discloses that an example of the distance between the paraboloidal concave surface of the reflector and the transducer element is 15 cm.

Second, the ultrasonic wave emitted from the transducer element is likely to spread three-dimensionally at a specific solid angle. Therefore, the paraboloidal concave surface of the reflector needs to be comparatively wide.

SUMMARY OF THE INVENTION

Accordingly, an object of the present invention to provide a super-directional loudspeaker that make it possible for a listener to receive an audible sound at a high sound pressure with a compact size.

Another object of the present invention to provide a super-directional loudspeaker that make it possible for a listener to receive an audible sound at a high sound pressure while preventing the circuit configuration of a loudspeaker system from being complicated and the fabrication cost thereof from being high.

Still another object of the present invention to provide a super-directional loudspeaker in which the location of a listening point is readily adjustable according to the location change of a listener.

The above objects together with others not specifically mentioned will become clear to those skilled in the art from the following description.

A super-directional loudspeaker according to the present invention is comprised of a supporting member having a concave surface, and electro-acoustic transducer elements fixed to the supporting member.

The elements are designed to receive an electrical input signal and to produce acoustic vibrations according to the electrical input signal thus received, thereby emitting directional ultrasonic waves in the air. The elements are arranged along the concave surface of the supporting member in such a way that the directional ultrasonic waves emitted by the elements propagate in the air to converge on a listening point in front of the concave surface.

With the super-directional loudspeaker according to the present invention, the electro-acoustic transducer elements are fixed to the supporting member to be arranged along the concave surface thereof. The elements are designed to receive the electrical input signal and to produce the acoustic vibrations according to the electrical input signal thus received, thereby emitting the directional ultrasonic waves in the air. Further, the elements are arranged along the concave surface of the supporting member in such a way that the directional ultrasonic waves from the elements propagate in the air to converge on the listening point in front of the concave surface.

Accordingly, if a listener is located at the listening point, he can receive an audible sound generated by the directional ultrasonic waves emitted from the elements at a high sound pressure.

Also, the electro-acoustic transducer elements are fixed to the supporting member to be arranged along its concave surface. In other words, the elements are not provided apart from supporting member. Therefore, the super-directional loudspeaker according to the present invention has a compact size and at the same time, the circuit configuration of a loudspeaker system using this loudspeaker is not complicated and the fabrication cost thereof is not high.

In a preferred embodiment of the super-directional loudspeaker according to the present invention, a curvature of the concave surface of the supporting member is adjustable. In this case, there is an additional advantage that the location of the listening point is readily adjustable according to the location change of the listener.

In another preferred embodiment of the super-directional loudspeaker according to the present invention, the electro-acoustic transducer elements are arranged regularly with respect to a center of the concave surface of the supporting member. In this case, there is an additional advantage that an obtainable sound pressure at the listening position becomes higher.

In this preferred embodiment, it is preferred that the electro-acoustic transducer elements are arranged circularly around the center of the concave surface of the supporting member, or closely adjacent to one another around the center of the concave surface of the member.

In still another preferred embodiment of the super-directional loudspeaker according to the present invention, a listener position recognizer and a curvature controller are additionally provided.

The listener position recognizor recognizes a listener position and outputs a position signal. The curvature controller controls a curvature of the concave surface of the supporting member according to the position signal from the listener position recognizor so that the listening point is overlapped with the recognized listener position. In this case, there is an additional advantage that even if the listener position is changed, the listener can always listen to the audible sound generated by the emitted directional ultrasonic waves.

In a further preferred embodiment of the super-directional loudspeaker system according to the present invention, the listener position recognizor has an acoustic-electric transducer for converting a reflected ultrasonic wave by the listener to an electric position signal, a delay time detector for detecting a delay time of the reflected ultrasonic wave from a difference between the electric position signal and the electrical input signal, thereby generating a delay time signal of the reflected ultrasonic wave, and a distance calculator for calculating a distance between the listening point and the listener position from the delay time signal. In this case, there is an additional advantage that the listener position recognizer is readily configured.

It is preferred that well-known piezoelectric transducer elements are used as the electro-acoustic transducer elements provided in the loudspeaker according to the first aspect of the present invention. This is because the piezoelectric transducer elements are capable of electro-acoustic and acousto-electric transducer operations and therefore, the piezoelectric transducer elements can be used not only as the electro-acoustic transducer elements fixed to the supporting member but also as the acousto-electric transducer element of the listener position recognizor.

The acousto-electric transducer may be fixed to the supporting member for the electro-acoustic transducer elements or provided apart from the supporting member.

It is preferred that the concave surface of the supporting member is formed by sector-shaped blades that are movable around the center of the concave surface. The blades are moved like a well-known aperture shutter of cameras by the curvature controller to change the curvature of the concave surface, thereby keeping an obtainable sound pressure at the listening point maximum.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
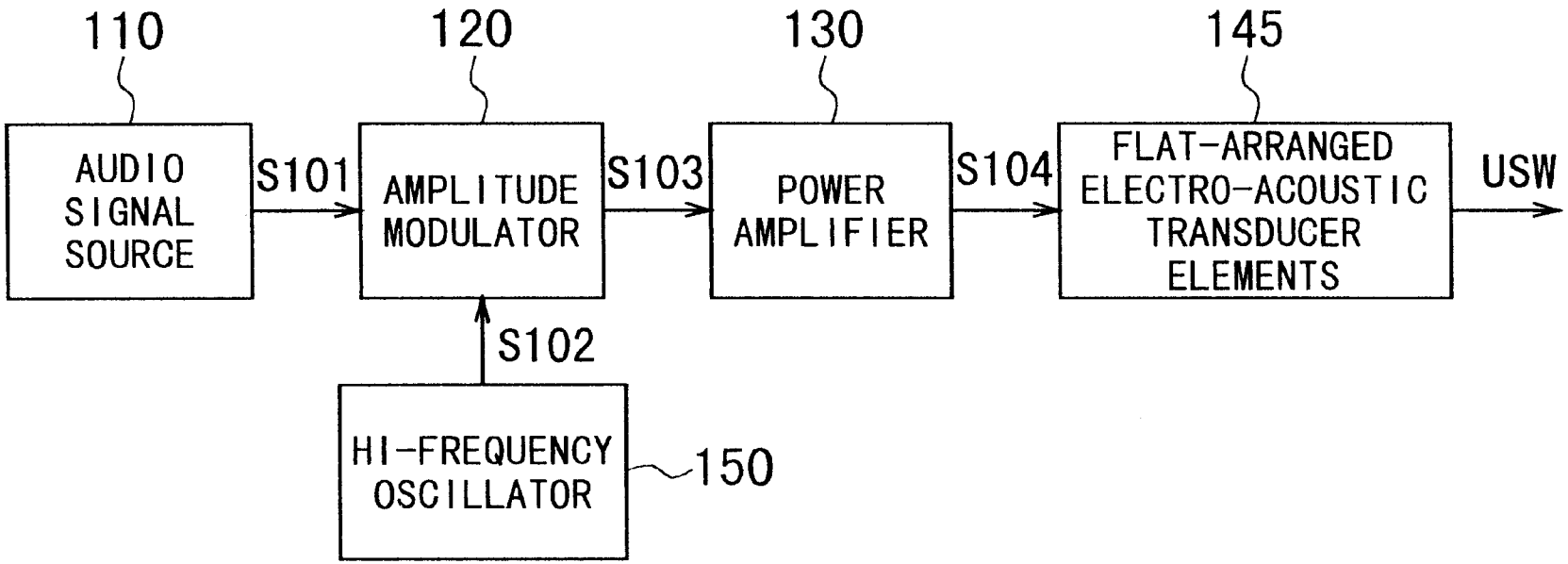
FIG. 1 PRIOR ART
FIG. 1 is a block diagram showing the common basic configuration of the conventional loudspeaker systems.

Preferred embodiments of the present invention will be described in detail below while referring to the drawings attached.

First Embodiment

Figure 2:
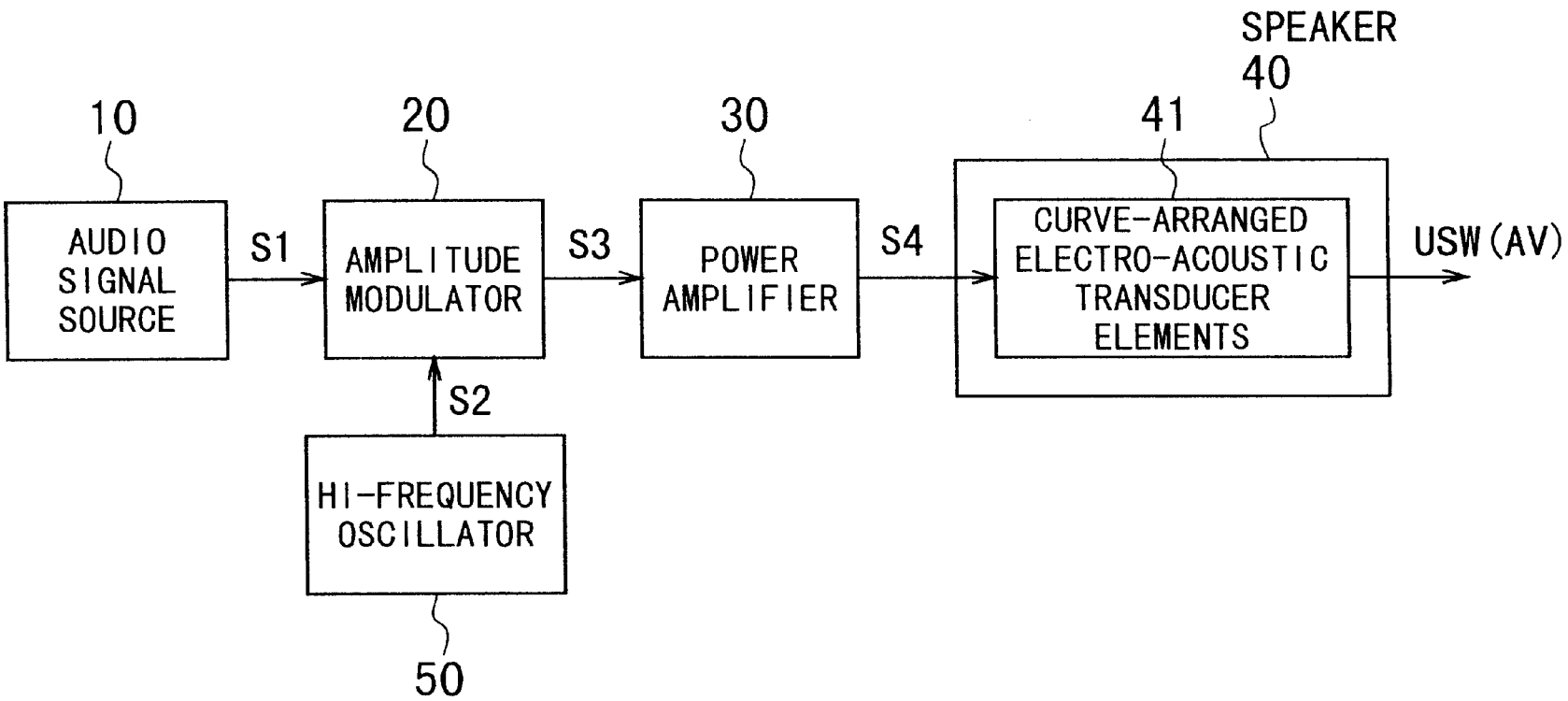
FIG. 2 is a block diagram showing the configuration of a super-directional loudspeaker system using a super-directional loudspeaker according to a first embodiment of the present invention.

FIG. 2 shows the configuration of a super-directional loudspeaker system using a super-directional loudspeaker according to a first embodiment of the present invention.

As shown in FIG. 2, this super-directional loudspeaker system comprises an audio signal source 10, a high-frequency oscillator 50, an amplitude modulator 20, a power amplifier 30, and a super-directional loudspeaker 40 according to the first embodiment.

The audio signal source 10 generates an electric audio signal S1 of an audio or audible frequency. As the signal source 10, for example, a cassette tape recorder that plays back recorded audio information onto a cassette tape to output an electric audible signal, a personal computer that reads out recorded audio information onto a hard disk to output an electric audible signal, or the like may be used. The electric audible signal S1 is applied to the amplitude modulator 20.

The high-frequency oscillator 50 generates an electric high-frequency signal S2 of a fixed ultrasonic frequency. As the high-frequency oscillator 50, a known clock generator circuit may be used. The electric high-frequency signal S2 is applied to the amplitude modulator 20.

The amplitude modulator 20 amplitude-modulates the high-frequency signal S2 from the high-frequency oscillator 50 by the audio signal S1 from the audio signal source 10, thereby producing a modulated ultrasonic signal S3 of the same ultrasonic frequency as that of the high-frequency signal S2. The modulated ultrasonic signal S3 is applied to the power amplifier 30.

The power amplifier 30 amplifies the modulated ultrasonic signal S3 to produce an amplified ultrasonic signal S4. For example, the amplified ultrasonic signal S4 has a voltage amplitude of 20 V to 40 V. If the modulated ultrasonic signal S3 has a sufficiently large amplitude, the power amplifier 30 may be canceled. The amplified ultrasonic signal S4 is applied to the super-directional loudspeaker 40.

Figure 3:
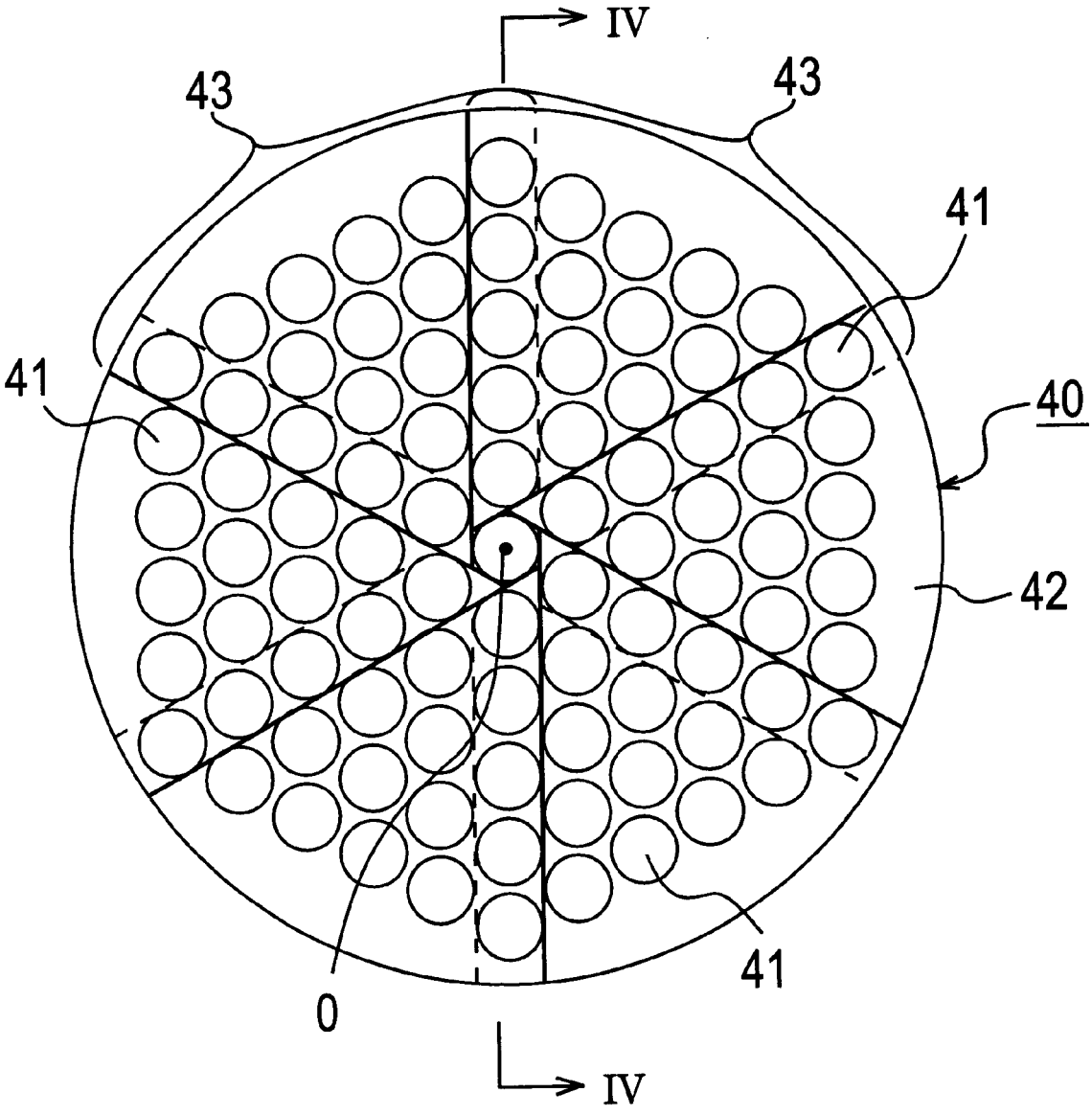
FIG. 3 is a front view of the super-directional loudspeaker according to the first embodiment of the present invention.
Figure 4:
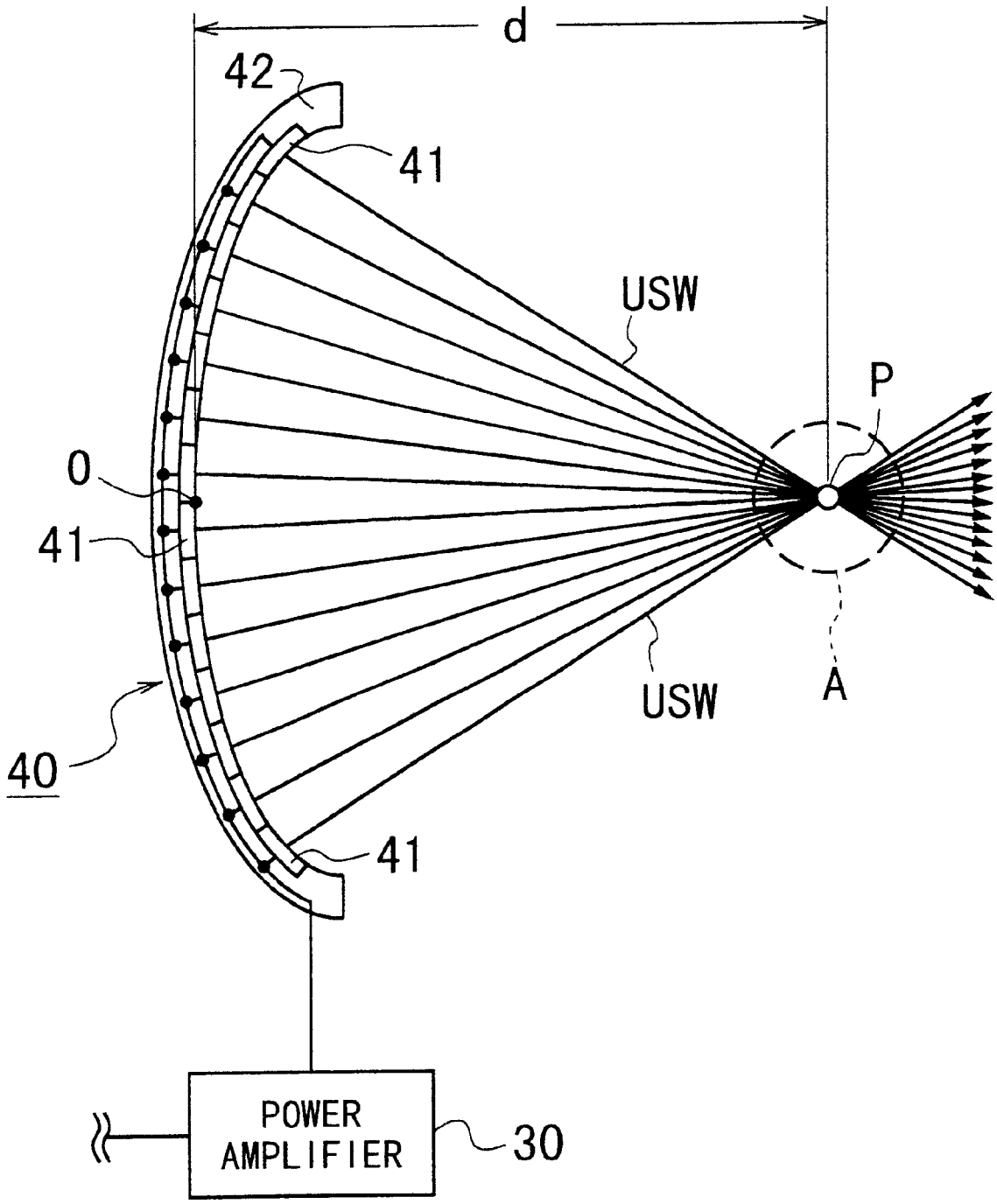
FIG. 4 is a cross-sectional view of the super-directional loudspeaker along the line IV—IV in FIG. 3.

As shown in FIGS. 3 and 4, the super-directional loudspeaker 40 comprises a plurality of electro-acoustic transducer elements 41 of a same type and a same size and a circular bowl-shaped supporting member 42. The inner concave surface of the member 42 is circular in the front view and arc-shaped in the cross-sectional view. The electro-acoustic transducer elements 41 are fixed onto the inner concave surface of the member 42. The elements 41 are arranged on the inner concave surface of the member 42 to be closely adjacent to one another. The elements 41 are approximately symmetrically arranged with respect to the center ) of the inner concave surface of the member 42.

The amplified ultrasonic signal S4 is commonly applied to the electro-acoustic transducer elements 41.

Each of the electro-acoustic transducer elements 41 converts the amplified ultrasonic signal S4 to an acoustic vibration AV of the same ultrasonic frequency as that of the high-frequency signal S2. The acoustic vibration AV thus generated produces and emits forward a high-directional ultrasonic wave USW in the air. The ultrasonic wave USW thus emitted propagates away from the element 41 through a listening point P in the air. Therefore, as shown in FIG. 4, the ultrasonic waves USW emitted from all the elements 41 propagate in the air to converge on the point P.

In the first embodiment, the contour of the supporting member 42 is of a circular shape. However, any other shape such as a square, rectangular, or elliptical shape may be applied as this contour. Also, for example, the number of the electro-acoustic transducer elements 41 is 91. However, it is needless to say that the number of the elements 41 may be any other number. The arrangement of the elements 41 on the supporting member 42 may be optionally changed if the ultrasonic waves USW emitted from the elements 41 propagate forward through the listening point P in the air.

The inner concave surface of the supporting member 42 may be of any shape such as a sphere, paraboloid, and so on if the ultrasonic waves USW emitted from the elements 41 propagate forward through the listening point P in the air. The type of the elements 41 may be optionally selected. For example, an ceramic piezoelectric transducer element may be preferably used for this purpose, because it is compact and is capable of reversible transducer operations, i.e., the electro-acoustic and acousto-electric conversions.

Next, the operation of the super-directional loudspeaker system shown in FIGS. 2 to 4 is explained below.

The electric audio signal S1 of the audio frequency supplied from the signal source 10 and the electric high-frequency signal S2 of the ultrasonic frequency from the high-frequency oscillator 50 are applied to the amplitude modulator 20. The high-frequency signal S2 is amplitude-modulated by the modulator 20 using the electric audible signal S1, thereby outputting the modulated ultrasonic signal S3 of the ultrasonic frequency to the power amplifier 30. The modulated ultrasonic signal S3 is amplified by the power amplifier 30 to output the amplified ultrasonic signal S4 of the ultrasonic frequency.

Finally, the amplified ultrasonic signal S4 is applied to the electro-acoustic transducer elements 41 of the super-directional loudspeaker 40, thereby converting the amplified ultrasonic signal S4 to the acoustic waves AV. The acoustic waves AV thus obtained produce and emit forward the ultrasonic waves USW in the air. All of the ultrasonic waves USW then propagate in the air so as to pass through the listening point P. This point P is located in front of the inner concave surface of the supporting member 42. The distance from the center O of the inner concave surface to the point P is set as d.

While the ultrasonic waves USW with the same ultrasonic frequency propagate forward in the air, a nonlinear interaction occurs between the ultrasonic waves USW and the air, resulting in demodulation operation of the ultrasonic waves USW due to the "parametric array effect". As a consequence, the inputted audio signal S1 of the audio frequency is reproduced or demodulated in the air to produce an audible sound according to the signal S1. The audible sound is transferred toward the listening point P and passing through the point P by the ultrasonic waves USW. Therefore, if a listener (not shown) is located at the listening point P, he can listen to the demodulated audible sound according to the input signal S1 at the maximum sound pressure.

A listening area A exists around the listening point P, as shown in FIG. 4. If the listener is located in the listening area A, he can listen to the demodulated audible sound at a comparatively high sound pressure which is lower than the maximum sound pressure. Therefore, the listener can listen to the audible sound at a sufficiently high sound pressure within the listening area A.

It is sufficient that the ultrasonic frequency of the high-frequency oscillator 50 is included in the ultrasonic frequency range which is equal to or higher than approximately 20 kHz. If the ultrasonic frequency of the high-frequency oscillator 50 is set as a value within a comparatively low ultrasonic frequency range of approximately 40 kHz, the sound pressure received by the listener can be raised. On the contrary, if the ultrasonic frequency of the high-frequency oscillator 50 is set as a value within a comparatively high ultrasonic frequency range of approximately 100 kHz to 300 kHz, the directivity of the audible sound received by the listener can be increased.

With the super-directional loudspeaker system shown in FIGS. 2 to 4, as described above, the electro-acoustic transducer elements 41 are fixed to the supporting member 42 to be arranged along the concave surface thereof in the super-directional loudspeaker 40. The elements 41 are designed to receive the electrical input signal S1 and to produce the acoustic vibrations AV according to the input signal S1 thus received, thereby emitting the directional ultrasonic waves USW in the air. Further, the elements 41 are arranged along the concave surface of the supporting member 42 in such a way that the directional ultrasonic waves USW from the elements 41 propagate in the air to converge on the listening point P in front of the concave surface.

Accordingly, if the listener is located at the listening point P, he can receive the audible sound generated by the directional ultrasonic waves USW emitted from the elements 41 at a satisfactorily high sound pressure.

Also, the electro-acoustic transducer elements 41 are fixed to the supporting member 42 to be arranged along its concave surface in the loudspeaker 40. In other words, the elements 41 are not provided apart from supporting member 42. Therefore, the super-directional loudspeaker 40 according to the first embodiment has a compact size and at the same time, the circuit configuration of the loudspeaker system using this loudspeaker 40 is not complicated and the fabrication cost thereof is not high.

Second Embodiment

Figure 5:
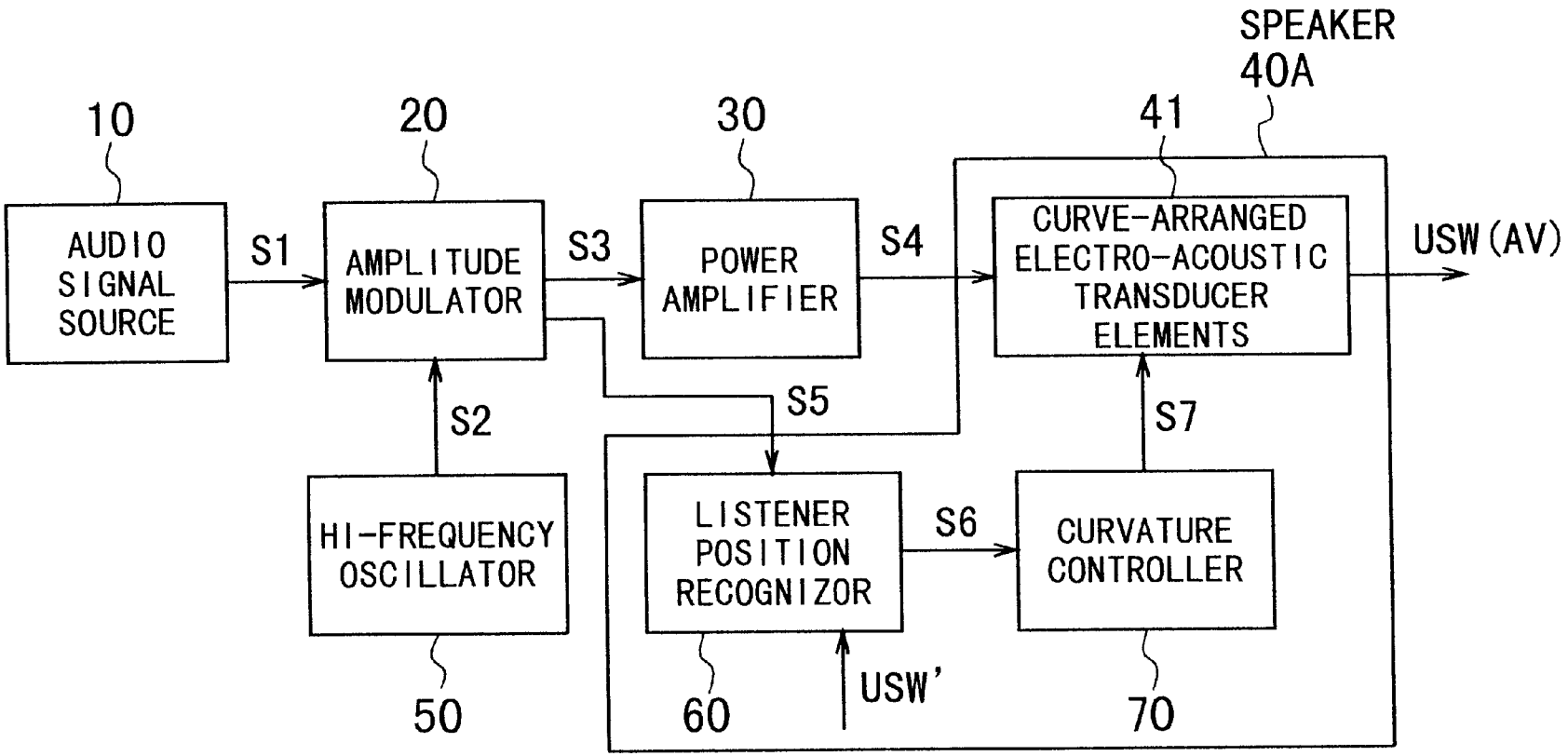
FIG. 5 is a block diagram showing the configuration of a super-directional loudspeaker system using a super-directional loudspeaker according to a second embodiment of the present invention.

FIG. 5 shows the configuration of a super-directional loudspeaker system using a super-directional loudspeaker 40A according to a second embodiment of the present invention.

As shown in FIG. 5, the super-directional loudspeaker 40A according to the second embodiment has a configuration obtained by adding a listener position recognizor 60 and a curvature controller 70 to the super-directional loudspeaker 40 according to the first embodiment. The other configuration is the same as that of FIG. 2. Therefore, explanation about the same configuration as that of the first embodiment is omitted here for the sake of simplification of description by attaching the same reference symbols as those in FIG. 2 to the same constituting elements in FIG. 5.

The listener position recognizor 60 recognizes a listener position and outputs a position signal S6 to the curvature controller 70 according to the recognized listener position. In response to the position signal S6 thus supplied, the curvature controller 70 outputs a control signal S7 to the electro-acoustic transducer elements 41 of the super-directional loudspeaker 40A, thereby controlling the curvature of the inner concave surface of the supporting member 42 so that the listening point P is overlapped with the existing listener position. Accordingly, the listener is always able to listen the demodulated audible sound at the maximum sound pressure even if he moves from a position to another.

Figure 6:
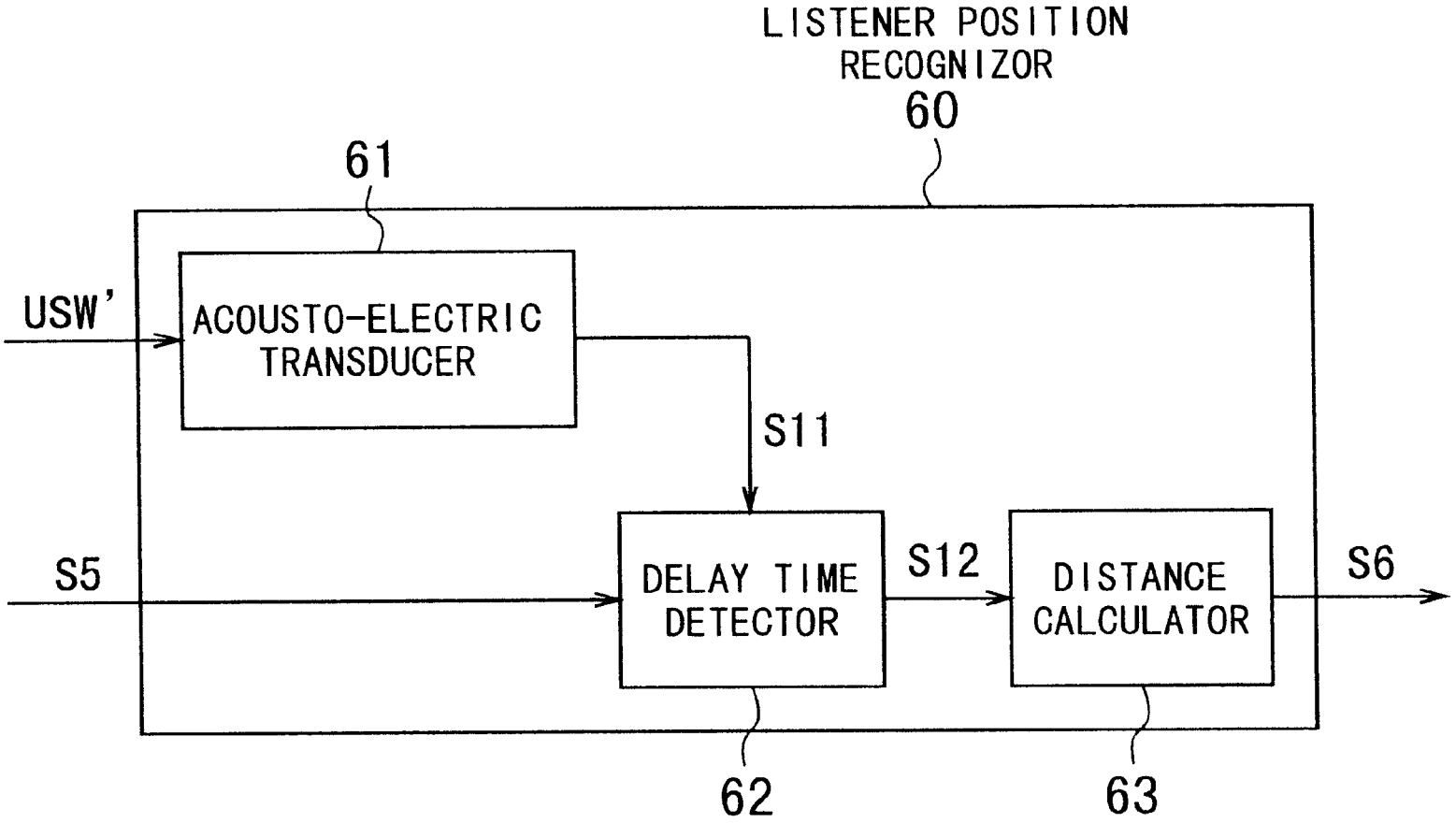
FIG. 6 is a block diagram showing the configuration of the listener position recognizor used in the super-directional loudspeaker according to the second embodiment of the present invention.

The listener position recognizor 60 has the configuration as shown in FIG. 6, which includes an acousto-electric transducer 61, a delay time detector 62, and a distance calculator 63.

The acousto-electric transducer 61 receives a reflected ultrasonic wave USW' generated due to reflection of the emitted ultrasonic waves USW from the electro-acoustic transducer elements 41 by the listener. The transducer 61 converts the received ultrasonic wave USW' to an electric signal S11 and outputs the signal S11 to the delay time detector 62.

The delay time detector 62 detects the time difference between the electric signal S11 from the acousto-electric transducer 61 and the electrical signal S5 from the amplitude modulator 20, thereby detecting a delay time of the reflected ultrasonic wave USW' with respect to the emitted ultrasonic waves USW. Then, the detector 62 outputs an electric signal S12 to the distance calculator 63 according to the detected delay time of the reflected ultrasonic wave USW'.

The distance calculator 63 calculates a distance between the listening point P and the existing listener position on the basis of the electric delay time signal S12. The calculator 63 outputs an electric signal S7 to the loudspeaker 40A according to the calculated distance, thereby changing the curvature of the supporting member 42 (i.e., the inner concave surface for the member 42) of the loudspeaker 40A.

The acousto-electric transducer 61 is typically fixed onto the inner concave surface of the supporting member 42 of the loudspeaker 40A. It is preferred that at least one of the electro-acoustic transducer elements 41 is used as the transducer 61, because the configuration of the loudspeaker 40A is simpler. However, at least one acousto-electric transducer element may be separately fixed onto the member 42 as the acousto-electric transducer 61.

Since the delay time detector 62 and the distance calculator 63 may be readily realized by known techniques, no detailed explanation is presented here.

Figure 7:
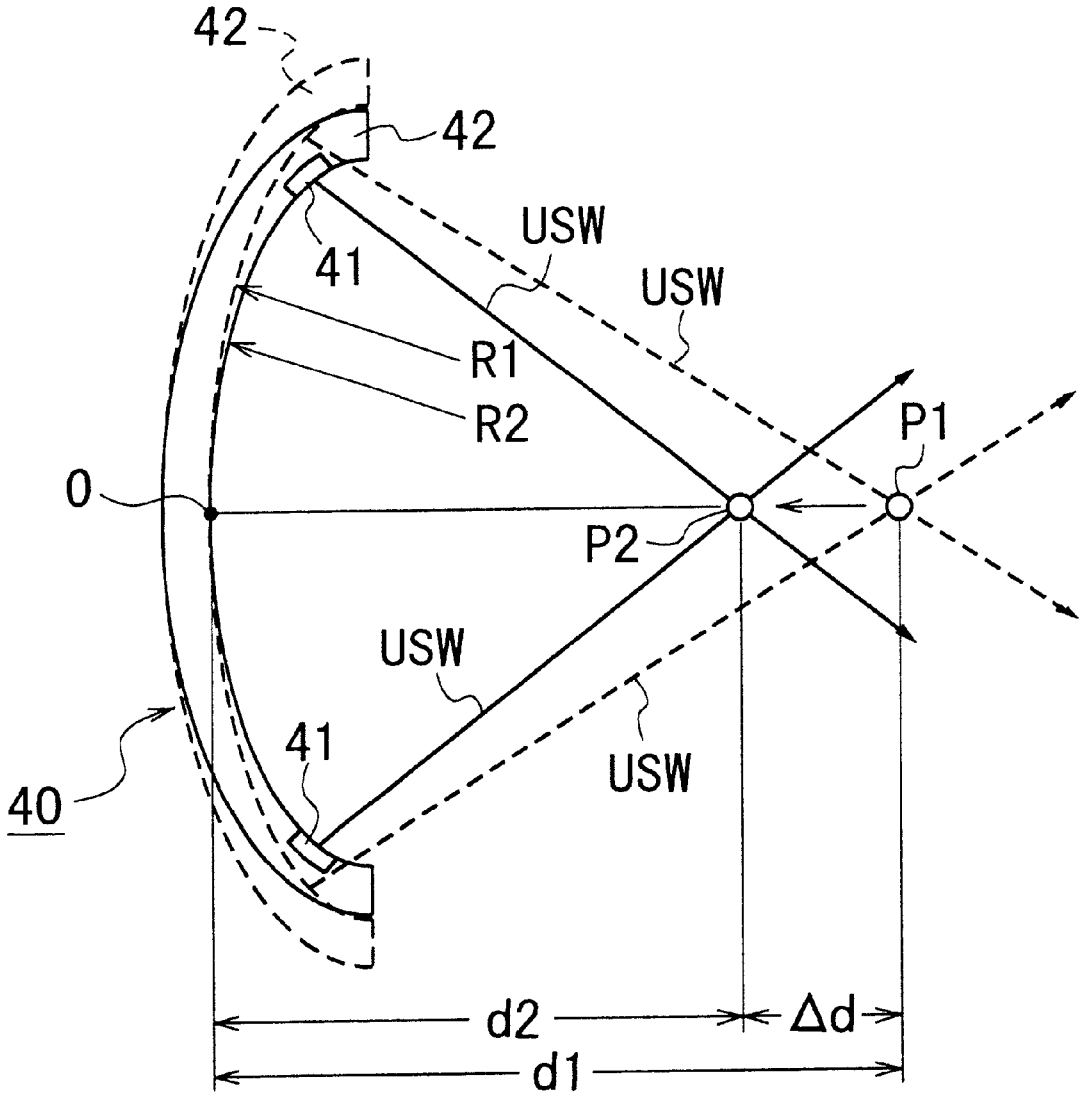
FIG. 7 is a cross-sectional view of the super-directional loudspeaker according to the second embodiment of the present invention, which shows the state of its curvature change.

For example, it is supposed that the listener is initially located at the position P1 shown in FIG. 7, which is apart from the center O of the supporting member 42 by a distance d1, and that he then moves toward the member 42 to the position P2 apart from the position P1 by a distance Δd, which is apart from the center O of the supporting plate 42 by a distance d2 (d2<d1).

In this case, the acousto-electric transducer 61 outputs the electric signal S11 according to the reflected ultrasonic wave USW', and then, the delay time detector 62 detects the delay time of the wave USW' from the electric signals S11 and S5, outputting the electric signal S12 according to the detected delay time. The distance calculator 63 calculates the distance Δd from the electric signal S12, outputting the electric control signal S6 to the curvature controller 70. Thus, the curvature of the transducer unit 40 is changed (i.e., enlarged) around the center O so that the listening point P is overlapped with the existing listener position P2.

On the other hand, if the listener moves to another new position (not shown) away from the supporting member 42 by a specific distance, the curvature of the inner concave surface of the member 42 is changed in the same way as above, so that the listening point P is overlapped with the new listener position.

The supporting member 42 may be formed by sector-shaped blades 43 that are movable around its center O. The blades are moved like an aperture shutter of a camera by the curvature controller 70 to change the curvature of the concave surface as necessary, thereby keeping an obtainable sound pressure at the listening point P maximum.

In the second embodiment, it is needless to say that there is the same advantage as those in the first embodiment. Moreover, there is an additional advantage that the location of the listening point P is readily adjustable according to the location change of the listener.

Third Embodiment

Figure 8:
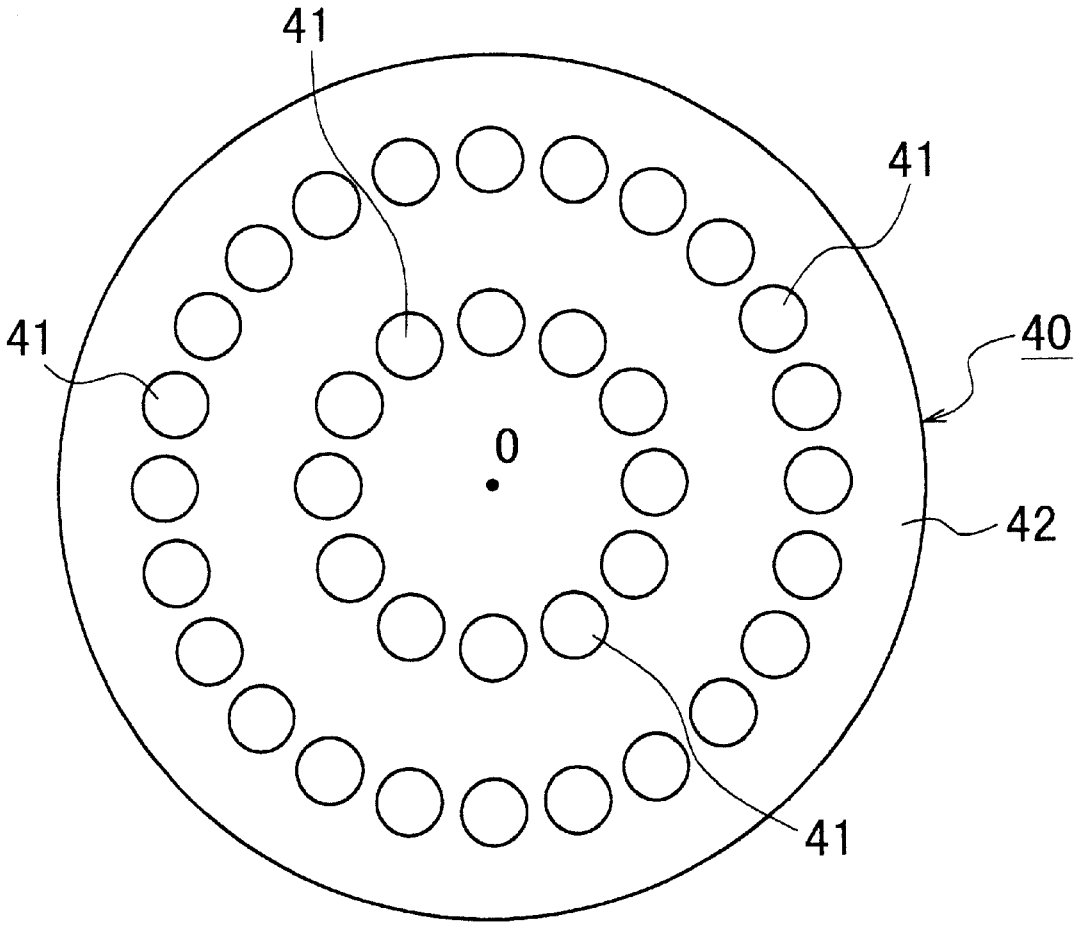
FIG. 8 is a front view of a super-directional loudspeaker according to a third embodiment of the present invention.

FIG. 8 shows a super-directional loudspeaker according to a third embodiment of the present invention, which shows another arrangement of the electro-acoustic transducer elements 41 on the inner concave surface of the supporting member 42.

Also in this third embodiment, the ultrasonic waves USW emitted from the electro-acoustic transducer elements 41 are designed to converge the listening point P shown in FIG. 4.

There is the same advantage as those in the first embodiment.

Additionally, it is obvious that a suitable known technique may be applied to the super-directional loudspeakers according to the above-described first to third embodiments. For example, to remove the bad effects of the ultrasonic waves USW to the human acoustic sense, a proper ultrasonic filter may be provided in the air near the concave surface of the supporting member 42. Also, one of different electric input signals of audio frequencies may be selectively applied to the amplitude modulator 20 according to the existence and absence of the listener.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A super-directional loudspeaker comprising:

a supporting member having a concave surface, wherein a curvature of said concave surface of said supporting member is adjustable;

electro-acoustic transducer elements fixed to the concave surface of said supporting member;

said elements being designed to receive an electrical input signal and to produce acoustic vibrations according to said electrical input signal thus received, thereby emitting directional ultrasonic waves modulated with an audible frequency signal in the air; and said elements being arranged circularly along said concave surface of said supporting member in such a way that said directional ultrasonic waves emitted by said elements propagate in the air to converge on a listening point in front of said concave surface at a distance sufficient for substantial demodulation of said directional ultrasonic waves.

2. The loudspeaker as claimed in claim 1, wherein said electro-acoustic transducer elements are arranged regularly with respect to a center of said concave surface of said supporting member.

3. The loudspeaker as claimed in claim 1, wherein said electro-acoustic transducer elements are arranged circularly around the center of said concave surface of said supporting member.

4. The loudspeaker as claimed in claim 1, wherein said electro-acoustic transducer elements are arranged adjacent to one another around the center of said concave surface of said member.

5. The loudspeaker as claimed in claim 1, wherein a piezoelectric transducer element is used as each of said electro-acoustic transducer elements.

6. A super-directional loudspeaker comprising:

a continuous supporting member having a concave surface;

electro-acoustic transducer elements fixed to said supporting member;

said elements being designed to receive an electrical input signal and to produce acoustic vibrations according to said electrical input signal thus received, thereby emitting directional ultrasonic waves in the air;

said elements being arranged along said concave surface of said supporting member in such a way that said directional ultrasonic waves emitted by said elements propagate in the air to converge on a listening point in front of said concave surface;

wherein said electro-acoustic transducer elements are arranged circularly around the center of said concave surface of said supporting member.

7. A super-directional loudspeaker comprising:

a supporting member having a concave surface;

electro-acoustic transducer elements fixed to said supporting member;

said elements being designed to receive an electrical input signal and to produce acoustic vibrations according to said electrical input signal thus received, thereby emitting directional ultrasonic waves in the air;

said elements being arranged circularly along said concave surface of said supporting member in such a way that said directional ultrasonic waves emitted by said elements propagate in the air to converge on a listening point in front of said concave surface; and a listener position recognizer and a curvature controller;

wherein said listener position recognizer recognizes a listener position and outputs a position signal; and wherein said curvature controller controls a curvature of said concave surface of said supporting member according to said position signal from said listener position recognizer so that said listening point is overlapped with said recognized listener position.

8. The loudspeaker as claimed in claim 7, wherein said listener position recognizor comprising:

an acousto-electric transducer for converting a reflected ultrasonic wave by said listener to an electric position signal;

a delay time detector for detecting a delay time of said reflected ultrasonic wave from a difference between said electric position signal and said electrical input signal, thereby generating a delay time signal of said reflected ultrasonic wave; and a distance calculator for calculating a distance between said listening point and said listener position from said delay time signal.

9. The loudspeaker as claimed in claim 7, wherein said electro-acoustic transducer elements are arranged regularly with respect to a center of said concave surface of said supporting member.

10. The loudspeaker as claimed in claim 7, wherein said electro-acoustic transducer elements are arranged circularly around the center of said concave surface of said supporting member.

11. The loudspeaker as claimed in claim 7, wherein said electro-acoustic transducer elements are arranged adjacent to one another around the center of said concave surface of said member.

12. The loudspeaker as claimed in claim 7, wherein a piezoelectric transducer element is used as each of said electro-acoustic transducer elements.

13. A super-directional loudspeaker comprising:

a supporting member having a concave surface;

electro-acoustic transducer elements fixed to said supporting member;

said elements being designed to receive an electrical input signal and to produce acoustic vibrations according to said electrical input signal thus received, thereby emitting directional ultrasonic waves in the air;

said elements being arranged circularly along said concave surface of said supporting member in such a way that said directional ultrasonic waves emitted by said elements propagate in the air to converge on a listening point in front of said concave surface;

wherein said concave surface of said supporting member is formed by sector-shaped blades that are movable around the center of the concave surface.

14. The loudspeaker as claimed in claim 13, wherein the electro-acoustic transducer elements are arranged regularly with respect to a center of said concave surface of said supporting member.

15. The loudspeaker as claimed in claim 13, wherein said electro-acoustic transducer elements are arranged circularly around the center of said concave surface of said supporting member.

16. The loudspeaker as claimed in claim 13, wherein said electro-acoustic transducer elements are arranged adjacent to one another around the center of said concave surface of said member.

17. The loudspeaker as claimed in claim 13, wherein a piezoelectric transducer element is used as each of said electro-acoustic transducer elements.

* * * * *